US007089843B2

(12) United States Patent
Miller et al.

(10) Patent No.: US 7,089,843 B2
(45) Date of Patent: Aug. 15, 2006

(54) MULTIPLE TUBE PNEUMATIC LAUNCHER

(75) Inventors: Stephen W. Miller, Cockeysville, MD (US); Steven J. Fox, Parkton, MD (US); David M. Feild, Lutherville, MD (US); Richard A. Bauernschub, Cockeysville, MD (US); Justin A. Mettee, Glen Rock, PA (US)

(73) Assignee: AAI Corporation, Hunt Valley, MD (US)

( * ) Notice: Subject to any disclaimer, the term of this patent is extended or adjusted under 35 U.S.C. 154(b) by 0 days.

(21) Appl. No.: 10/503,625

(22) PCT Filed: Mar. 29, 2004

(86) PCT No.: PCT/US2004/009427

§ 371 (c)(1),
(2), (4) Date: Dec. 15, 2005

(87) PCT Pub. No.: WO2005/001372

PCT Pub. Date: Jan. 6, 2005

(65) Prior Publication Data

US 2006/0086241 A1 Apr. 27, 2006

Related U.S. Application Data

(60) Provisional application No. 60/458,402, filed on Mar. 31, 2003.

(51) Int. Cl.
*F41F 3/042* (2006.01)
*F41F 3/052* (2006.01)

(52) U.S. Cl. ..... 89/1.806; 89/1.812; 89/1.815; 89/1.816

(58) Field of Classification Search ..... 89/1.806, 89/1.812, 1.815, 1.816
See application file for complete search history.

(56) References Cited

U.S. PATENT DOCUMENTS

| | | | | |
|---|---|---|---|---|
| 4,444,085 | A * | 4/1984 | Dragonuk | 89/1.51 |
| 4,941,392 | A * | 7/1990 | Huetter | 89/1.51 |
| 5,381,721 | A * | 1/1995 | Holmstrom et al. | 89/1.51 |
| 5,400,690 | A | 3/1995 | Meili et al. | |
| 6,526,860 | B1 | 3/2003 | Facciano et al. | |

FOREIGN PATENT DOCUMENTS

FR 2 634 549 A1 1/1990

* cited by examiner

*Primary Examiner*—Stephen M. Johnson
(74) *Attorney, Agent, or Firm*—Venable LLP; Stuart I. Smith

(57) ABSTRACT

A launcher includes a plurality of launch tubes for stowing and launching a plurality of air vehicles. A central air manifold is operatively connected to an air storage tank; a first launch tube air manifold is operatively connected to a first group of the launch tubes and operatively connected to the central air manifold. The first launch tube air manifold has a separate port corresponding to each launch tube of the first group of launch tubes. A release valve mechanism is removably mounted in one of the ports of the first launch tube air manifold, the release valve mechanism controlling the passage of launch air between the first launch tube air manifold and the launch tube corresponding to the port in which the release valve mechanism is mounted. A plug is removably mounted in each of the ports not occupied by the release valve mechanism.

19 Claims, 4 Drawing Sheets

MULTIPLE TUBE PNEUMATIC LAUNCHER

This application claims priority to U.S. Provisional Patent Application No. 60/458,402, filed Mar. 31, 2003.

BACKGROUND OF THE INVENTION

The present invention relates generally to lightweight air vehicles and launchers used for lightweight air vehicles, and more particularly to multiple tube pneumatic launchers for unmanned aerial vehicles ("UAVs").

Lightweight unmanned air vehicles are becoming very popular for various uses including surveillance and package delivery in military and law enforcement situations. Launchers for launching multiple UAVs are needed to facilitate the simultaneous use of multiple UAVs or a second launching without having to recover the initially launched UAV.

BRIEF SUMMARY OF THE INVENTION

The invention provides a smooth acceleration, compressed air launch environment for firing a plurality of UAVs from a single launch platform or vehicle. A tube launcher in accordance with the invention has a plurality of UAVs packaged in a launch pod that fits on, for example, a mobile launch vehicle. An electrically actuated elevation and deployment mechanism is fitted between the pod and the vehicle chassis. Each pre-fueled and launch-ready UAV is individually launched out of its tube by compressed air with, in this example, the vehicle motor running. The packaged tube configuration allows for automatic deployment of wing and tail section surfaces of the UAV after launch to transform the UAV into the flight configuration.

Embodiments of the invention provide a launcher for launching a plurality of air vehicles. The launcher has a plurality of launch tubes, each launch tube for containing one of the plurality of air vehicles in a stowed condition and for launching that air vehicle; an air storage tank for storing launch air under pressure; a central air manifold operatively connected to the air storage tank; a first launch tube air manifold operatively connected to a first group of the launch tubes and operatively connected to the central air manifold, the first launch tube air manifold having a separate port corresponding to each launch tube of the first group of launch tubes; a release valve mechanism removably mounted in one of the ports of the first launch tube air manifold, the release valve mechanism controlling the passage of launch air between the first launch tube air manifold and the launch tube corresponding to the port in which the release valve mechanism is mounted; and a plurality of plugs, each of the plugs being removably mounted in one of the ports not occupied by the release valve mechanism. The launch tubes corresponding to the ports in which the plugs are mounted are incapable of launching the air vehicles.

Further objectives and advantages, as well as the structure and function of preferred embodiments will become apparent from a consideration of the description, drawings, and examples.

BRIEF DESCRIPTION OF THE DRAWINGS

The foregoing and other features and advantages of the invention will be apparent from the following, more particular description of preferred embodiments of the invention, as illustrated in the accompanying drawings wherein like reference numbers generally indicate identical, functionally similar, and/or structurally similar elements.

DETAILED DESCRIPTION OF TEE INVENTION

Embodiments of the invention are discussed in detail below. In describing embodiments, specific terminology is employed for the sake of clarity. However, the invention is not intended to be limited to the specific terminology so selected. While specific exemplary embodiments are discussed, it should be understood that this is done for illustration purposes only. A person skilled in the relevant art will recognize that other components and configurations can be used without parting from the spirit and scope of the invention.

Figure 1:
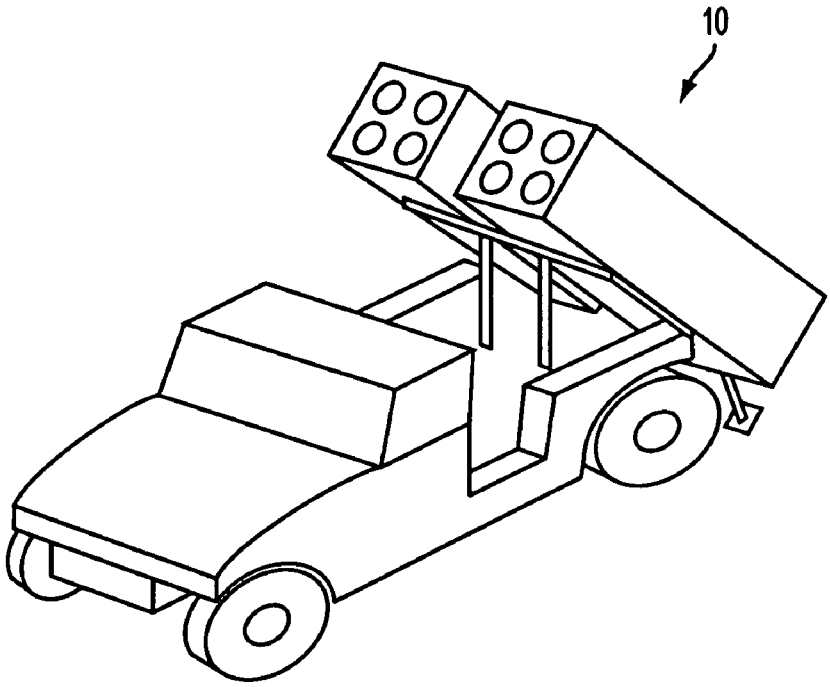
FIG. 1 is a schematic representation of a launcher in accordance with an example of an embodiment of the invention.
Figure 2:
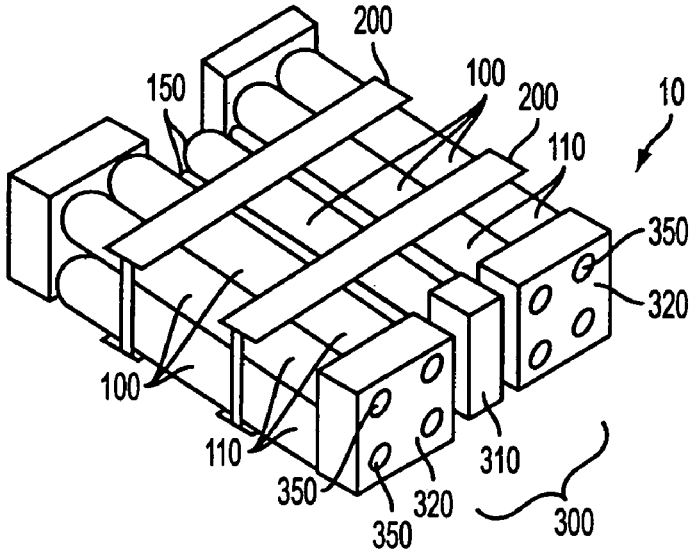
FIG. 2 is a perspective view of an embodiment of the invention in a closed position.
Figure 3:
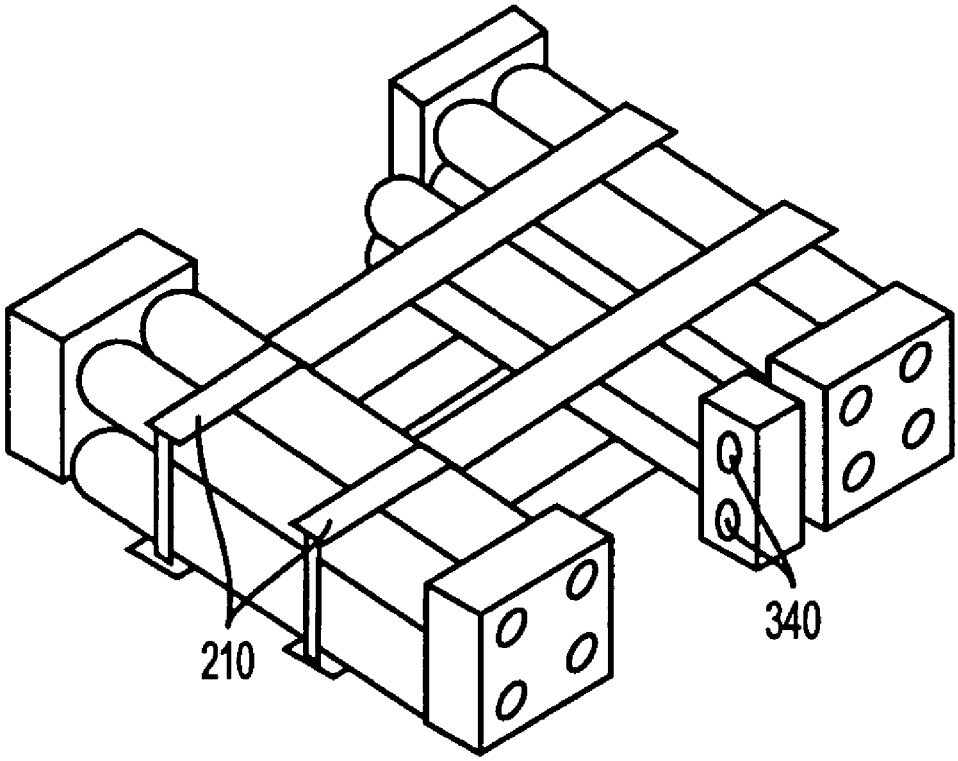
FIG. 3 is a perspective view of the embodiment shown in FIG. 2 in an open position.

An example of a vehicle mounted launcher pod 10 in accordance with the invention is shown in FIG. 1. FIGS. 2 and 3 show launcher pod 10 removed from the vehicle. This particular example is 120 inch long, 86 inch wide and 41 inch high. Other dimensions can be used as needed for particular applications. This launcher pod is a lightweight structure, having composite tubes 100 support by intermediate frame members 200, all connected to a rear mounted manifold assembly 300. Composite tubes 100 in this example have an inside diameter of fifteen and one-half inches, are filament wound and are capable of resisting pressures up to four times the design working pressure of 70 psi. Similar tubes can be used for both the launch tubes 110 and the air storage tanks 150.

Manifold assembly 300 provides an air flow path from air storage tanks 150 to launch tubes 110. The manifold assembly, in this example a cast aluminum assembly, is divided into three sections to provide a quick uncoupling feature. One launch tube air manifold 320 is removably coupled to each side of a central air manifold 310. In this example, each launch tube air manifold 320 is attached to four launch tubes 110 that each contain a UAV ready for launch. The quick coupling feature is provided to allow the four launch tubes 110 on each side of the launcher to slide (as an assembly with the corresponding launch tube air manifold 320) to the side to provide access to the front of the tubes for easy loading of the UAV.

The embodiment shown in FIG. 1 is similar in concept to a commercial tilt-bed car carrier. Two motions are required; roll back and tilt. The roll back feature is provided to translate the launcher pod in the aft direction sufficiently to allow a single UAV to be indexed forward. Indexing of the UAV forward exposes the front portion of the UAV to allow for preflight preparation, which includes manual unfolding and locking of the propeller.

The tilt back feature is provided to elevate the launch tubes to achieve a specified, in this example 50-degree, launch angle. Incorporated in the roll back frame are footplates, which are used to transmit the launch force reaction directly to the ground. Both roll back and tilt mechanisms are powered, in this example, by electric ball screw actuators, which are capable of locking in position in the event of a power failure.

As shown in FIG. 3, the launcher incorporates features to facilitate recovery and loading of UAVs. Linear bearing slide tracks 210 and the manifold assembly 300, which includes a quick-connect seal feature 340, are provided to permit the launch tube assemblies to shift to the side to allow for front-loading the UAV by a soldier standing on the ground. A crane (not shown), mounted for example in the center of the vehicle behind the cab, is capable of pivoting and extending to provide lift capability to load a UAV into one of the launch tubes. The loading procedure is similar for both launch tube subassemblies.

The tube launcher utilizes a large volume low-pressure air supply to accelerate the UAV to its flight speed, for example 70 knots. The pneumatic system can have an electrically driven compressor, air storage tanks and an electrically powered valve/release mechanism.

Figure 4:
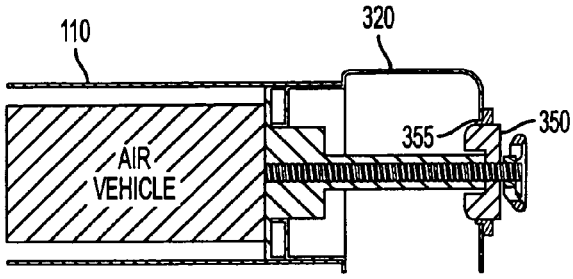
FIG. 4 is a partial sectional view of an embodiment of the invention with the inert plug in place.
Figure 5:
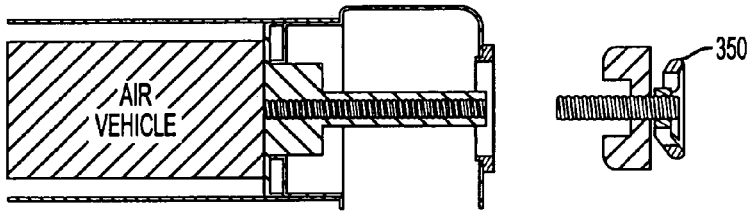
FIG. 5 is a partial sectional view of the embodiment of FIG. 4 with the inert plug removed.
Figure 6:
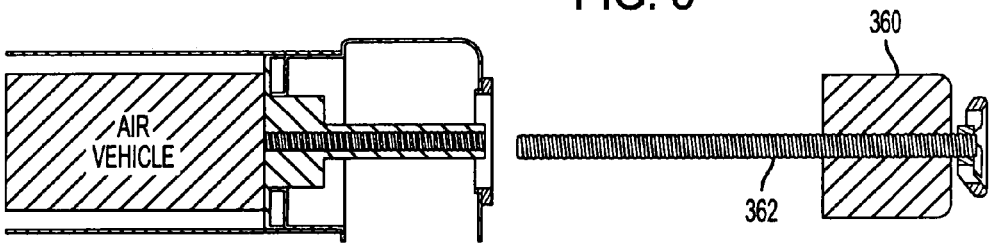
FIG. 6 is a partial sectional view of the embodiment of FIG. 4 with the release valve mechanism positioned for insertion.
Figure 7:
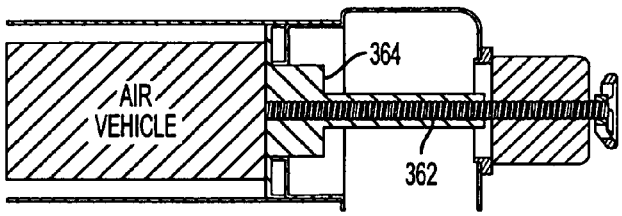
FIG. 7 is a partial sectional view of the embodiment of FIG. 4 with the release valve mechanism initially inserted.
Figure 8:
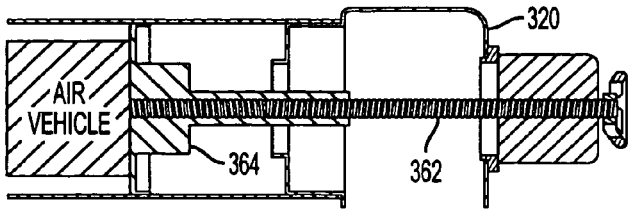
FIG. 8 is a partial sectional view of the embodiment of FIG. 4 with the pusher disk pushed part way into the launch tube.
Figure 9:
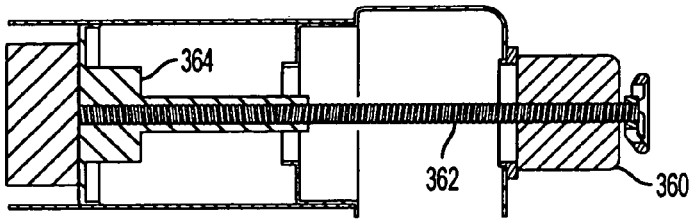
FIG. 9 is a partial sectional view of the embodiment of FIG. 4 with the pusher disk on the verge of being released by the release valve mechanism.

FIGS. 4–13 show an example of a launch sequence. FIG. 4 shows an inert plug 350 mounted in a port 355 in launch tube air manifold 320. Each launch tube 110 has a corresponding port 355 in launch tube air manifold 320. To initiate the launch sequence, inert plug 350 is removed (FIG. 5) and a release valve mechanism 360 is installed in the port 355 corresponding to the launch tube 110 of the UAV chosen for launch (FIGS. 6 and 7). As shown in FIGS. 7 and 8, an electric motor in release valve mechanism 360 connected to a screw assembly 362 powers open an air valve (six-inch diameter, in this example) formed between launch tube 110 and launch tube air manifold 320 by a pusher disk 364. In addition to opening the air valve, the movement of pusher disc 364 also pushes the UAV forward in launch tube 110 a predetermined distance (for example, 18 inches) to allow access to the forward portion of the UAV so it can be fueled and the engine can be started. An air compressor is then started to begin pressurizing the air system, including the manifolds and the launch tube 110 that contains the UAV to be launched. An air tank (in this case, two large air tanks 150) and central air manifold 310 (30 cubic foot total volume, in this example) are located between the launch tubes subassemblies and are connected to launch tube air manifolds 320 that are attached to each group of four launch tubes 110. The central air manifold has a quick disconnect feature 340 (FIG. 3) that allows each of the two-by-two subassemblies to be extended sideway for reloading. The launch tube air manifolds act as additional air reservoirs of, for example, 9.5 cubic feet each, and the launch tube 110 with the air vehicle positioned for flight supplies an additional 1.9 cubic feet of air volume. Maintaining large volume airflow is preferable to the successful operation of the launcher. The large air tanks, and the large air passages between the tanks, manifold, and launch tube ensure an ample supply of air for launch. At the completion of the charging cycle, a total of 50 cubic feet of volume will be charged to a launch pressure of 70 PSI.

Figure 10:
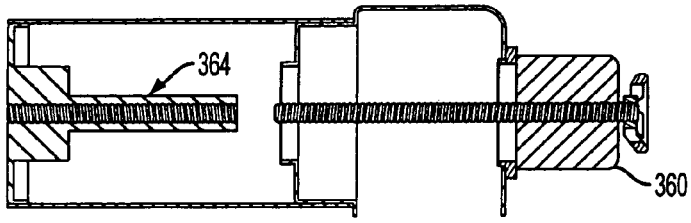
FIG. 10 is a partial sectional view of the embodiment of FIG. 4 after the pusher disk is released by the release valve mechanism.
Figure 11:
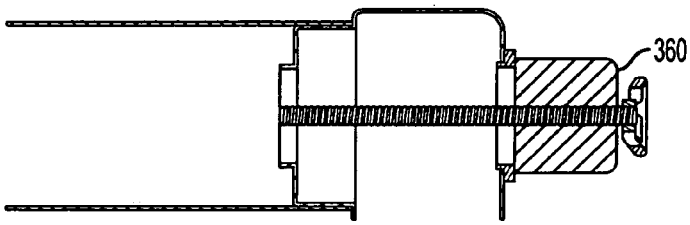
FIG. 11 is a partial sectional view of the embodiment of FIG. 4 after the pusher disk and air vehicle have left the launch tube.
Figure 12:
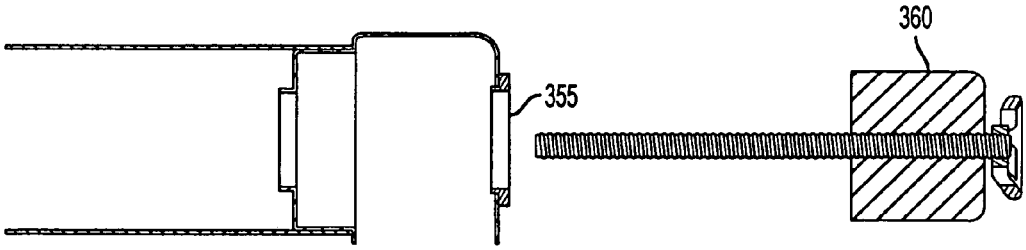
FIG. 12 is a partial sectional view of the embodiment of FIG. 4 with the release valve mechanism removed form the manifold.

To launch, release valve mechanism 360 is again powered (FIG. 9) until pusher disc 364 separates from power screw 362 as shown in FIGS. 10 and 11. Air pressure, now acting on the unrestrained pusher disc 364, accelerates the UAV and pusher disk 364 out of launch tube 110. With an initial pressure of 70 psi pushing on a pusher disc with an area of 188 $in^2$, the aircraft is initially accelerated at 32 Gs and continues to the end of launch tube 110. At the end of the launch stroke, the air vehicle will be traveling at, for example, 70 knots with a residual air pressure of 54 psi. At the end of the launch stroke, pusher disc 364 will fall to the ground in a safe zone established in front of the launcher.

Figure 13:
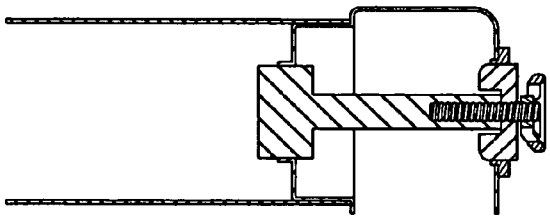
FIG. 13 is a partial sectional view of the embodiment of FIG. 4 with the inert plug reinserted into the manifold.

After launch, release valve mechanism 360 is removed from port 355 (FIG. 12) and inert plug 350 is reinstalled into port 355 of launch tube manifold 320 to plug the opening created by the previous launch (FIG. 13). Release valve mechanism 360 is then repositioned to the next UAV to be launched.

The tube launch system is capable of self-deployment and sustainment without supplies for 72 hours of operation. It is capable of off road mobility, provides UAV launch capability and is capable of recovering and reloading the UAVs.

In transport mode, the tube launch system can include the launch vehicle and an equipment trailer. The trailer is provided to carry sustainment provisions, soldiers' gear, equipment and spare parts.

The entire launch sequence, including engine start and launch can be controlled from a safe location utilizing a remote controller via an umbilical cable or a wireless link.

It is to be understood that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention.

The embodiments illustrated and discussed in this specification are intended only to teach those skilled in the art the best way known to the inventors to make and use the invention. Nothing in this specification should be considered as limiting the scope of the invention. All examples presented are representative and non-limiting. The above-described embodiments of the invention may be modified or varied, without departing from the invention, as appreciated by those skilled in the art in light of the above teachings. It is therefore to be understood that the invention may be practiced otherwise than as specifically described.

We claim:

1. A launcher for launching a plurality of air vehicles, the launcher comprising:

a plurality of launch tubes, each launch tube for containing one of the plurality of air vehicles in a stowed condition and for launching that air vehicle;

an air storage tank for storing launch air under pressure;

a central air manifold operatively connected to the air storage tank;

a first launch tube air manifold operatively connected to a first group of the launch tubes and operatively connected to the central air manifold, the first launch tube air manifold having a separate port corresponding to each launch tube of the first group of launch tubes;

a release valve mechanism removably mounted in one of the ports of the first launch tube air manifold, the release valve mechanism controlling the passage of launch air between the first launch tube air manifold and the launch tube corresponding to the port in which the release valve mechanism is mounted; and a plurality of plugs, each of the plugs being removably mounted in one of the ports not occupied by the release valve mechanism, wherein the launch tubes corresponding to the ports in which the plugs are mounted are incapable of launching the air vehicles.

2. The launcher of claim 1, wherein each of the launch tubes has a pusher disk associated therewith, the pusher disk being for pushing the air vehicle out of the launch tube during launch.

3. The launcher of claim 2, wherein the pusher disk is engaged by the release valve mechanism when the release valve mechanism is mounted in the port corresponding to the launch tube with which the pusher disk is associated.

4. The launcher of claim 3, wherein the pusher disk and the release valve mechanism are engaged by a threaded connection.

5. The launcher of claim 4, wherein the pusher disk creates a seal with an inner wall of the launch tube.

6. The launcher of claim 5, wherein the pusher disk does not rotate relative to the launch tube.

7. The launcher of claim 5, wherein the release valve mechanism further comprises a threaded shaft, and the release valve mechanism pushes the pusher disk along an axial direction of the launch tube by rotating the threaded shaft within the threaded connection between the release valve mechanism and the pusher disk.

8. The launcher of claim 7, wherein the release valve mechanism is capable of pushing the pusher disk from a manifold sealing position to a launch air release position, the launch air release position being a position of the pusher disk that allows launch air to move from the first launch tube air manifold to the launch tube, and at which the pusher disk is still engaged by the release valve mechanism.

9. The launcher of claim 8, wherein the release valve mechanism is capable of pushing the pusher disk to a pusher disk release position at which the pusher disk is no longer engaged by the release valve mechanism and at which the pusher disk is free to travel through the launch tube under force created by the pressure of the launch air.

10. The launcher of claim 9, wherein the traveling of the pusher disk through the launch tube is for pushing the air vehicle from the launch tube so as to launch the air vehicle.

11. The launcher of claim 1, wherein the first launch tube manifold and the first group of the launch tubes is capable of separating as a unit from the central air manifold.

12. The launcher of claim 11, further comprising a disconnectable coupling between the first launch tube manifold and the central air manifold.

13. The launcher of claim 1, further comprising a second launch tube air manifold operatively connected to a second group of the launch tubes and operatively connected to the central air manifold, the second launch tube air manifold having a separate port corresponding to each launch tube of the second group of launch tubes.

14. The launcher of claim 13, wherein the first launch tube manifold and the first group of the launch tubes is capable of separating as a unit from the central air manifold.

15. The launcher of claim 14, wherein the first launch tube manifold and the first group of the launch tubes separates as a unit from the central air manifold for facilitating loading of the air vehicles into the launch tubes.

16. The launcher of claim 15, wherein the second launch tube manifold and the second group of the launch tubes is capable of separating as a unit from the central air manifold.

17. The launcher of claim 16, wherein the second launch tube manifold and the second group of the launch tubes separates as a unit from the central air manifold for facilitating loading of the air vehicles into the launch tubes.

18. The launcher of claim 17, further comprising a motorized mobile chassis to which the plurality of launch tubes, the air storage tank, the central air manifold, the first launch tube air manifold, and the second launch tube air manifold are mounted.

19. The launcher of claim 1, further comprising a motorized mobile chassis to which the plurality of launch tubes, the air storage tank, the central air manifold, and the first launch tube air manifold are mounted.

* * * * *